United States Patent [19]

Pahade et al.

[11] Patent Number: 4,479,871

[45] Date of Patent: Oct. 30, 1984

[54] PROCESS TO SEPARATE NATURAL GAS LIQUIDS FROM NITROGEN-CONTAINING NATURAL GAS

[75] Inventors: Ravindra F. Pahade, North Tonawanda; John B. Saunders; James J. Maloney, both of Tonawanda, all of N.Y.

[73] Assignee: Union Carbide Corporation, Danbury, Conn.

[21] Appl. No.: 570,664

[22] Filed: Jan. 13, 1984

[51] Int. Cl.[3] ..... C10G 5/00; B01D 51/00

[52] U.S. Cl. ..... 208/340; 55/23; 55/85

[58] Field of Search ..... 208/340, 341, 342, 343, 208/344, 345, 346; 55/23, 85

[56] References Cited

U.S. PATENT DOCUMENTS

| | | | |
|---|---|---|---|
| 2,134,702 | 10/1938 | Brewster | 208/340 |
| 2,250,949 | 7/1941 | Gerlach | 55/23 |
| 2,367,284 | 1/1945 | Kaplan | 208/345 |
| 2,409,691 | 10/1946 | Woble | 208/345 |
| 2,617,276 | 11/1952 | Gard et al. | 208/340 |
| 3,028,332 | 4/1962 | Forbes et al. | 208/340 |
| 3,062,015 | 11/1962 | Cost | 55/23 |
| 3,536,610 | 10/1970 | Stork | 208/340 |
| 3,932,156 | 1/1976 | Stern | 208/341 X |
| 4,061,481 | 12/1977 | Campbell et al. | 62/29 |
| 4,140,504 | 2/1979 | Campbell et al. | 62/28 |
| 4,157,904 | 6/1979 | Campbell et al. | 62/27 |
| 4,171,964 | 10/1979 | Campbell et al. | 62/24 |
| 4,278,457 | 7/1981 | Campbell et al. | 62/24 |
| 4,410,342 | 10/1983 | Horton | 62/23 |

*Primary Examiner*—Delbert E. Gantz
*Assistant Examiner*—Glenn A. Caldarola
*Attorney, Agent, or Firm*—Stanley Ktorides

[57] ABSTRACT

A process which effectively separates and recovers natural gas liquids from a natural gas stream containing nitrogen, regardless of the magnitude of the nitrogen concentration or changes in the nitrogen concentration.

22 Claims, 2 Drawing Figures

PROCESS TO SEPARATE NATURAL GAS LIQUIDS FROM NITROGEN-CONTAINING NATURAL GAS

TECHNICAL FIELD

This invention relates to the separation of natural gas liquids from natural gas which additionally contains nitrogen, and is particularly applicable in those applications where the natural gas reservoir undergoes an enhanced recovery operation which includes nitrogen injection.

BACKGROUND ART

Natural gas liquids are hydrocarbons containing two or more carbon atoms which are normally found in natural gas reservoirs. Examples of natural gas liquids are ethane, propane and butane. When recovering natural gas, i.e. methane, from a natural gas reservoir, it is desirable to separate the natural gas liquids from the natural gas and recover the two separately. This is because natural gas liquids have a higher economic value than methane for use as fuel such as propane or liquified petroleum gas, or for use as chemical feedstocks. When nitrogen is also present in the natural gas reservoir, it is desirable to separate the nitrogen from the hydrocarbons while not adversely affecting the separation of natural gas liquids from the natural gas. A reservoir may have a naturally occurring nitrogen content of from 0 to 90 percent, generally from 3 to 5 percent.

As hydrocarbon resources become scarcer and more difficult to recover, secondary recovery operations are becoming more widespread. Such secondary recovery operations are commonly referred to as enhanced oil recovery (EOR) and enhanced gas recovery (EGR) operations. One such secondary recovery technique involves the injection of a gas which does not support combustion into a reservoir to raise reservoir pressure in order to remove hydrocarbons which cannot be removed from the reservoir by natural reservoir pressure. A commonly used gas for this process is nitrogen because it is relatively abundant and inexpensive and can be produced in large quantities at the reservoir site.

The injection of nitrogen into the reservoir will result, over time, in the presence of increased concentrations of nitrogen in the natural gas recovered from the reservoir. The nitrogen concentration of the fluid recovered from the reservoir can be from the naturally occurring concentration to as high as 90 percent or more. Furthermore the nitrogen concentration of the recovered gas does not remain constant, but tends to increase over time as more and more nitrogen is employed to keep reservoir pressure at a point where recovery can proceed. This has an adverse effect on the recovery of natural gas liquids separate from the natural gas.

The increasing concentration of nitrogen in the wellhead stream complicates the effective separation of natural gas liquids from natural gas because a process which may be effective at a relatively low nitrogen concentration, such as around 5 percent may be ineffective at a high nitrogen concentration, such as greater than 50 percent. Thus a process to separate natural gas liquids from nitrogen containing natural gas recovered from a reservoir which has undergone nitrogen injection must have sufficient flexibility to effectively carry out the separation over a wide range of nitrogen concentrations.

It is therefore an object of this invention to provide an improved process for separating natural gas liquids from natural gas which also contains nitrogen.

It is another object of this invention to provide a process to effectively separate natural gas liquids from nitrogen-containing natural gas having a relatively high nitrogen concentration.

It is a further object of this invention to provide a process to effectively separate natural gas liquids from nitrogen-containing natural gas wherein the nitrogen concentration may vary from the naturally occurring concentration to as much as 90 percent or more.

SUMMARY OF THE INVENTION

The above and other objects which will become apparent to one skilled in the art upon a reading of this disclosure are attained by the process of this invention one aspect of which is:

A process for the separation of natural gas liquids from methane and nitrogen comprising:

(1) partially condensing a feed stream having a pressure in the range of from 300 to 1500 psia and containing natural gas liquids, methane and nitrogen to produce a vapor stream A and a liquid stream B;
(2) partially condensing stream A to produce a vapor stream C and a liquid stream D;
(3) partially vaporizing stream B to produce a vapor stream E and a liquid stream F;
(4) introducing streams D and F into a first demethanizer for separation into a methane-rich fraction and a bottom liquid containing natural gas liquids;
(5) partially vaporizing said bottom liquid from the first demethanizer to produce a vapor stream G and a liquid stream H;
(6) partially condensing streams C and E to produce a vapor stream I and a liquid stream J;
(7) partially vaporizing stream J to produce a vapor stream K and a liquid stream L;
(8) introducing stream L into a second demethanizer for separation into a methane-enriched fraction and a bottom liquid containing natural gas liquids;
(9) partially vaporizing said bottom liquid from the second demethanizer to produce a vapor stream M and a liquid stream N;
(10) introducing stream M into the second demethanizer;
(11) introducing streams G and N into the first demethanizer; and
(12) recovering stream H as product natural gas liquids whereby the presence of nitrogen and any changes which may occur in the concentration of nitrogen in the feed stream are prevented from having a significant impact on the hydrocarbon separation.

Another aspect of the process of this invention is:

A process for the separation of natural gas liquids from a feed stream having a pressure in the range of from 300 to 1500 psia and containing natural gas liquids, methane and not more than about 20 percent nitrogen comprising:

(1) partially condensing said feed stream to produce a first vapor stream and a first liquid stream;
(2) expanding to partially vaporize said first liquid stream;
(3) heating said partially vaporized stream;

(4) separating said partially vaporized stream into a second vapor stream and a second liquid stream;

(5) partially condensing said first vapor stream to produce a third vapor stream and a third liquid stream;

(6) introducing said second and third liquid streams into a demethanizer wherein they are separated into a methane-rich fraction and a bottom liquid containing natural gas liquids;

(7) partially vaporizing said bottom liquid to provide vapor, for upflow through the demethanizer and remaining liquid; and (8) recovering said remaining liquid as product natural gas liquids.

The term "column" is used herein to mean a distillation or fractionation column, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For an expanded discussion of fractionation columns see the Chemical Engineer's Handbook, Fifth Edition, edited by R. H. Perry and C. H. Chilton, McGraw-Hill Book Company, New York Section 13, "Distillation" B. D. Smith et al., page 13-3, *The Continuous Distillation Process.*

The term "double column", is used herein to mean a high pressure column having its upper end in heat exchange relation with the lower end of a low pressure column. An expanded discussion of double columns appears in Ruheman, "The Separation of Gases" Oxford University Press, 1949, Chapter VII, Commercial Air Separation, and Barron, "Cryogenic Systems", McGraw-Hill, Inc., 1966, p. 230, Air Separation Systems.

The term "demethanizer" is used herein to mean a column wherein a liquid feed containing methane and natural gas liquids is introduced into the column to descend down the column and thereby the more volatile components are removed or stripped from the descending liquid by a rising vapor stream.

The terms "natural gas liquids" and "higher hydrocarbons" are used herein to mean hydrocarbons having two or more carbon atoms. These hydrocarbons are not necessarily in the liquid state.

DETAILED DESCRIPTION

The invention will be described in detail with reference to the drawings.

Figure 1:
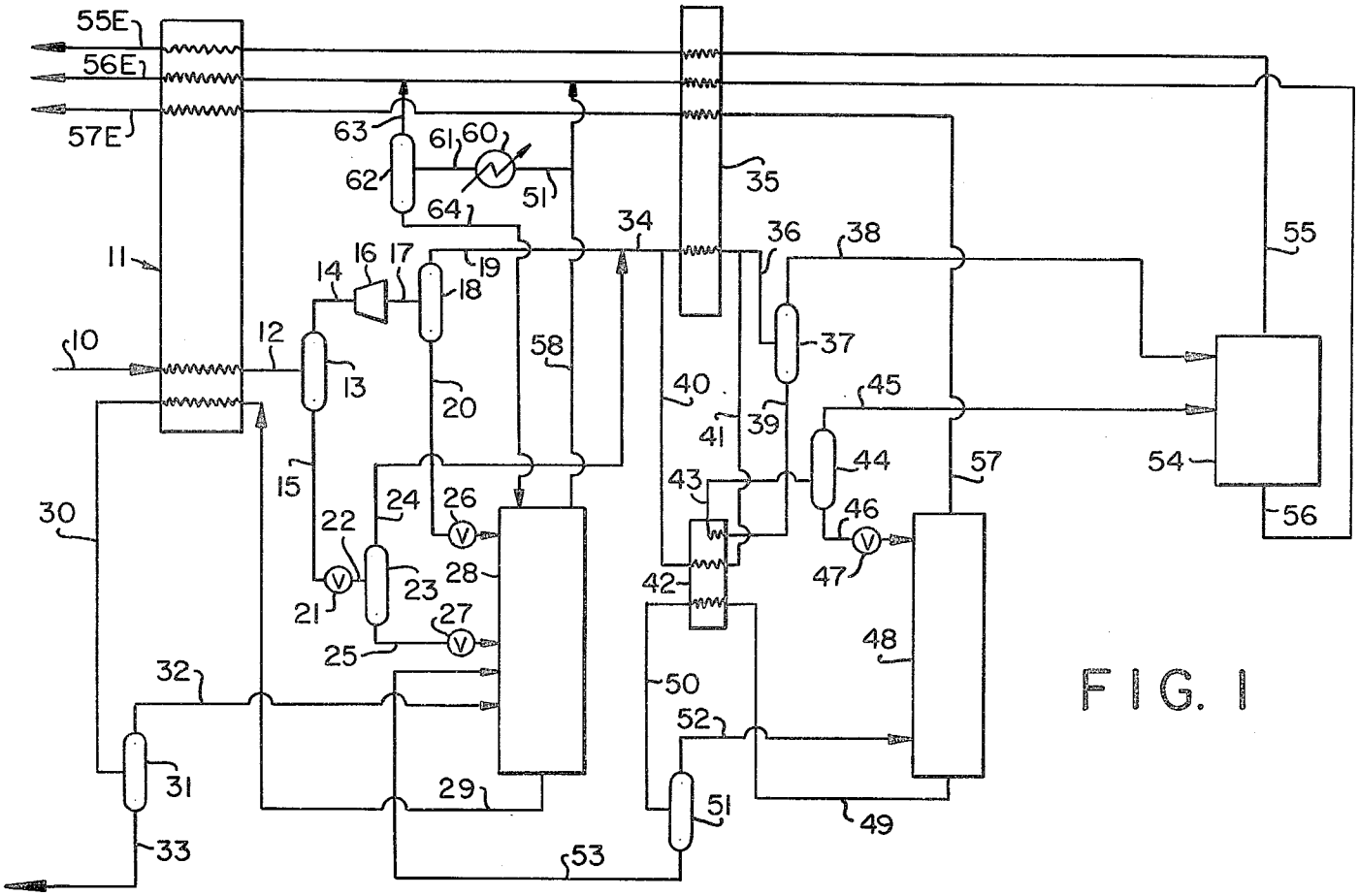
FIG. 1 is a flow diagram of one preferred embodiment of the process of this invention.

Referring now to FIG. 1, feed stream 10 is a gaseous stream which is typically recovered from a natural gas well or petroleum reservoir after some processing to remove water vapor, carbon dioxide, sulfur compounds and possibly other high boiling compounds such as heavy hydrocarbons having seven or more carbon atoms. Stream 10 is generally at ambient temperature and generally at a pressure in the range of from 300 to 1500 psia and contains methane, nitrogen and natural gas liquids. The nitrogen concentration may be in the range of from 3 to 90 percent. When nitrogen-injection secondary recovery techniques are employed, the nitrogen concentration of the feed will tend to increase over time. Unless otherwise specified all percentages herein are mole percentages. The feed may also contain hydrogen and unsaturated hydrocarbons such as when it is passed through a cracking unit.

Feed stream 10 is partially condensed to form a vapor stream A and a liquid stream B. In FIG. 1 stream 10 is partially condensed by cooling in heat exchange 11 against return streams and demethanizer bottoms. Other cooling, in addition to that shown in FIG. 1, could include external propane refrigeration. The partially condensed stream 12 is fed to phase separator 13 and separated into vapor stream 14 (stream A) and liquid stream 15 (stream B).

Stream A is partially condensed to produce a vapor stream C and a liquid stream D. In FIG. 1, stream 14 is partially condensed by turbo expansion through turbo-expander 16 and the partially condensed stream 17 is fed to phase separator 18 and separated into vapor stream 19 (stream C) and liquid stream 20 (stream D).

Stream B is partially vaporized to produce vapor stream E and liquid stream F. In FIG. 1, stream 15 is partially vaporized by expansion through valve 21 and the partially vaporized stream 22 is fed to phase separator 23 and separated into vapor stream 24 (stream E) and liquid stream 25 (stream F). Although not shown, stream 15 could be heated after expansion through valve 21.

Streams D and F are introduced into a first demethanizer as liquid feed. Due to the initial partial condensation of the feed and to the subsequent respective partial condensation and partial vaporization, with the attendant phase separations, the more volatile component of the feed, i.e., nitrogen, is caused to pass in large part into the vapor streams C and E, thus leaving little or no nitrogen in the liquid streams D and F which are fed to the first demethanizer 28. In FIG. 1 streams 20 and 25 are passed through valves 26 and 27 respectively and into first demethanizer 28 which is operating at a pressure in the range of from 100 to 600 psia, preferably from 200 to 450 psia.

In demethanizer 28 the feeds are separated into a methane-rich fraction and a bottom liquid containing a significant concentration of natural gas liquids.

The bottom liquid from the first demethanizer is partially vaporized to produce vapor stream G and liquid stream H. In FIG. 1, the bottom liquid is withdrawn from demethanizer 28 as stream 29 and partially vaporized by warming through heat exchanger 11 against cooling feed stream 10. The partially vaporized stream 30 is fed to phase separator 31 and separated into vapor stream 32 (stream G) and liquid stream 33 (stream H). Stream H is recovered as product natural gas liquids. The concentration of natural gas liquids in stream H will vary and will depend on the relative concentrations of the feed stream components and on natural gas liquid product specifications. Generally the concentration of natural gas liquids in stream H will exceed 75 percent and often will exceed 90 percent. Furthermore stream H will contain very little or no nitrogen even when the nitrogen concentration of the feed exceeds 90 percent.

Stream G is returned to the first demethanizer. In FIG. 1 stream 32 is returned to demethanizer 28 at the lower end of the column and provides vapor upflow for the column separation against the descending liquid.

As an alternative to the FIG. 1 arrangement, the bottom liquid need not be withdrawn from the first demethanizer and instead can be reboiled at the bottom of the column by a portion of the feed gas or other appropriate heat source. In such an alternative arrangement, stream G would be the boiled off vapor from the bottoms and stream H would be withdrawn directly out the bottom of the first demethanizer.

Another variation not illustrated would include the use of side reboilers in the demethanizer that could use heat available from the feed stream.

Streams C and E which contain most of the nitrogen which was in the feed are partially condensed to produce vapor stream I and liquid stream J. In FIG. 1 streams 24 and 19 are first combined and the combined stream 34 is partially condensed by cooling through heat exchanger 35 against return streams. The partially condensed stream is fed to phase separator 37 and separated into vapor stream 38 (stream I) and liquid stream 39 (stream J). Alternatively streams 19 and 24 could each separately traverse heat exchanger 35 and be combined following the traverse or be separately fed to phase separator 37. In FIG. 1 a portion 40 of combined stream 34 is branched off and cooled against bottom liquid from the second demethanizer and returned to the main stream. The cooled branched stream 41 could be returned to the main stream downstream of heat exchanger 35, as shown in FIG. 1, or could be returned upstream of heat exchanger 35.

Stream J is partially vaporized to produce a vapor stream K and a liquid stream L. In FIG. 1, stream 39 is warmed and partially vaporized by passage through heat exchanger 42 against branched stream 40. The partially vaporized stream is fed to phase separator 44 and separated into vapor stream 45 (stream K) and liquid stream 46 (stream L).

Due to the partial vaporization of the nitrogen bearing stream(s) and subsequent partial vaporization of the resulting liquid stream, most of the nitrogen which entered the process with the feed is caused, due to its higher volatility, to pass into vapor streams I and K thus leaving only a minor amount of nitrogen in liquid stream L which is introduced as feed into the second demethanizer.

In FIG. 1, stream 46 is passed through valve 47 and introduced into second demethanizer 48 which is operating at a pressure in the range of from 50 to 600 psia, preferably from 100 to 400 psia. In demethanizer 48 the feed is separated into a methane-enriched fraction and a bottom liquid containing natural gas liquids.

The bottom liquid from the second demethanizer is partially vaporized to produce vapor stream M and liquid stream N. In FIG. 1, the bottom liquid is withdrawn from demethanizer 48 as stream 49 and partially vaporized by warming through heat exchanger 42 against cooling stream 40. The partially vaporized stream 50 is fed to phase separator 51 and separated into vapor stream 52 (stream M) and liquid stream 53 (stream N).

Stream N is introduced into the first demethanizer. In FIG. 1, stream 53 is introduced separately from other streams into demethanizer 28. Alternatively, stream 53 could be combined with stream 25 after the valve expansion prior to introduction into demethanizer 28. As a further variation, each of these streams could be heated, as in exchanger 60, prior to introduction into demethanizer 28.

Stream M is returned to the second demethanizer. In FIG. 1, stream 52 is returned to demethanizer 48 at the lower end of the column and provides vapor upflow for the column separation against the descending liquid.

As an alternative to the FIG. 1 arrangement, the bottom liquid need not be withdrawn from the second demethanizer and instead can be reboiled at the bottom of the column by an appropriate heat source. In such an alternative arrangement, stream M would be the boiled off vapor from the bottom and stream N would be withdrawn directly out the bottom of the second demethanizer.

FIG. 1 illustrates the process of this invention in conjunction with a comprehensive system which separates the methane from the nitrogen and recovers the methane and, if desired, the nitrogen. In such a comprehensive process, and as shown in FIG. 1, streams 38 and 45 are introduced into a nitrogen rejection unit 54. Streams 38 and 45 may, if desired, undergo further cooling as by turbo or valve expansion prior to introduction into unit 54. The nitrogen rejection unit may be a single cryogenic column, a double column, or any effective means to separate nitrogen from methane. The separation in unit 54 produces nitrogen stream 55 and methane stream 56 which are both passed through heat exchangers 35 and 11 and removed or recovered as streams 55E and 56E respectively. The methane-enriched fraction from the second demethanizer is withdrawn as stream 57 and this stream also passes through the heat exchangers prior to being removed or recovered as stream 57E.

FIG. 1 also illustrates another alternative to the process of this invention. The methane-rich fraction from the first demethanizer is withdrawn as stream 58 and combined with stream 56 prior to removal and recovery. In the alternative shown in FIG. 1, all or a portion 59 of stream 58 is cooled and partially condensed by cooling means 60. The partially condensed stream 61 is fed to phase separator 62 and separated into vapor stream 63 and liquid stream 64. Vapor stream 63 is passed to stream 56 prior to removal and recovery. Liquid stream 64 is returned to demethanizer 28 as descending liquid. This feature leads to improved natural gas liquid recovery from the overhead stream, i.e., the methane product stream, therefore giving the process additional natural gas liquid recovery flexibility.

The process of this invention successfully addresses the problem of effectively separating and recovering natural gas liquids from a methane mixture when the methane mixture also contains nitrogen. Although the process of this invention is effective at any nitrogen concentration in the feed, it is more attractive when the nitrogen concentration in the feed exceeds about 10 percent, and preferably when it exceeds about 20 percent. The process of this invention is successful, in large part, by negating the detrimental effect on hydrocarbon separation caused by the higher volatility of nitrogen. The detrimental effect is negated by the defined system of partial phase changes and separations which have a combined cumulative effect of substantially removing nitrogen from the hydrocarbon separation. Since the absolute amount of nitrogen in the feed does not harm the ability of the process of this invention to successfully recover natural gas liquids, changes in the concentration of nitrogen in the feed similarly fail to harm the recovery capability of the invention. This makes the process of the invention ideal for processing a stream from a gas or oil reservoir which has undergone an enhanced recovery operation by nitrogen injection. Furthermore, the process of this invention is also effective when other relatively volatile components, such as helium, are present in the feed.

Another advantage of the process of this invention is the minimization of the natural gas liquid recovery flexibility on the methane-nitrogen separation, i.e., the two separations have little impact on each other.

When the concentration of nitrogen in the feed stream is relatively low, i.e., not more than 20 percent and preferably not more than 10 percent, another embodiment of the process of this invention may be more attractive. Such an embodiment is illustrated in FIG. 2.

Figure 2:
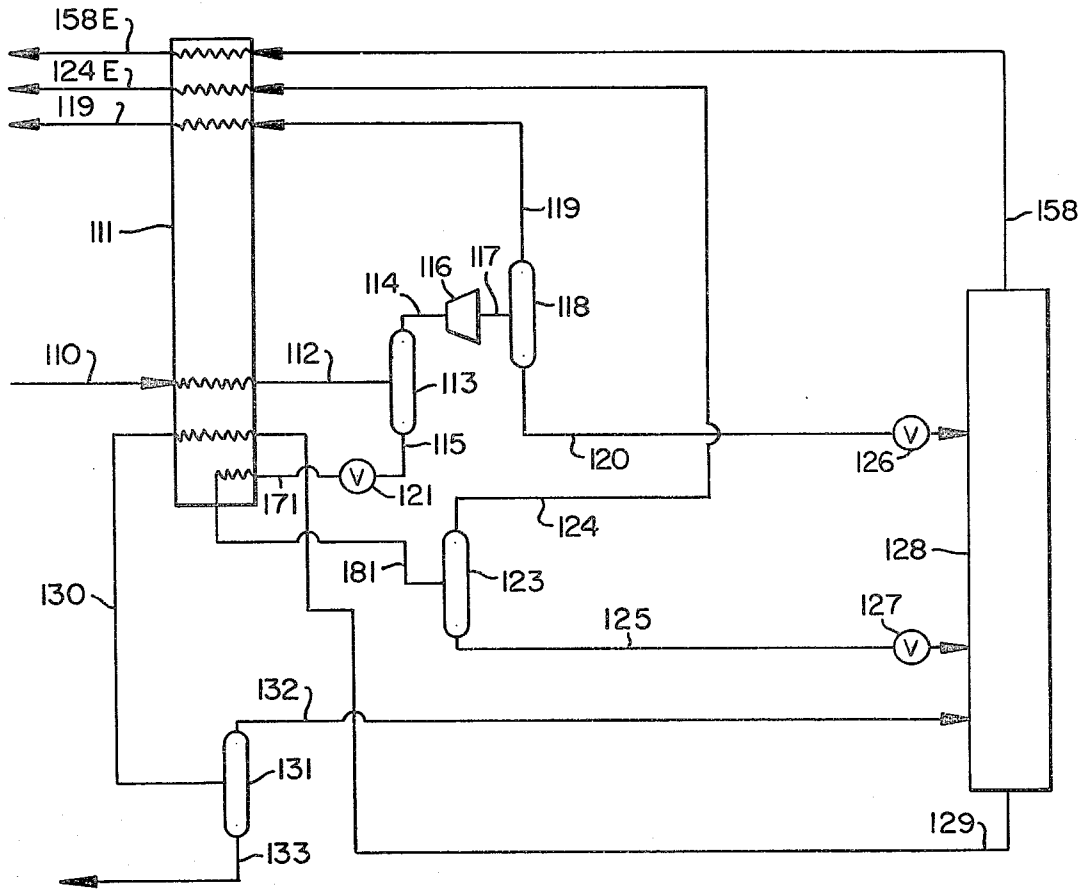
FIG. 2 is a flow diagram of another embodiment of this invention which may be preferred when the nitrogen concentration in the feed stream does not exceed about 20 percent.

Referring now to FIG. 2, feed stream 110, generally at about ambient temperature, having a pressure in the range of from 300 to 1500 psia and containing natural gas liquids, methane and not more than about 20 percent nitrogen is partially condensed to produce a first vapor stream and a first liquid stream. In FIG. 2, stream 110 is partially condensed by passage through heat exchanger 111 against return streams and demethanizer bottoms. The partially condensed stream 112 is fed to phase separator 113 and separated in the first vapor stream 114 and the first liquid stream 115.

Stream 115 is expanded through valve 121 and partially vaporized, and the partially vaporized stream 171 is heated by any convenient source such as versus the feed stream in heat exchanger 111. The heating further vaporizes some of the liquid portion of stream 171. The heated partially vaporized stream 181 is passed to phase separator 123 and separated into second vapor stream 129 and second liquid stream 125.

Stream 114 is partially condensed to produce a third vapor stream and a third liquid stream. In FIG. 2, stream 114 is partially condensed by turboexpansion through turboexpander 116 and the partially condensed stream 117 is fed to phase separator 118 and separated into the third vapor stream and the third liquid stream.

The second and third liquid streams, 125 and 120, are passed respectively through valves 127 and 126 and introduced into demethanizer 128 operating at a pressure in the range of from 100 to 600 psia, preferably from 200 to 450 psia. In demethanizer 128 they are separated into a methane-rich fraction and a bottom liquid containing natural gas liquids.

The bottom liquid is partially vaporized to provide vapor for upflow through the demethanizer and the remaining liquid is recovered as product containing a significant fraction of natural gas liquids.

In FIG. 2 the bottom liquid is withdrawn from demethanizer 128 as stream 129 and partially vaporized by passage through heat exchanger 111. The partially vaporized stream 130 is fed to phase separator 131 and separated into vapor stream 132, which is returned to demethanizer 128 as vapor upflow, and into remaining liquid stream 133 which is recovered as product having a natural gas liquids concentration of at least 75 percent and generally 90 percent or more. Alternatively the bottom liguid need not be withdrawn from the demethanizer and instead can be reboiled at the bottom of the column by an appropriate heat source. In such an arrangement the remaining liquid would be removed from the bottom of the column and recovered containing product natural gas liquids.

The second and third vapor streams, 124 and 119 in FIG. 2, along with the methane-rich fraction from the demethanizer which is shown as withdrawn stream 158, may be each passed through heat exchanger 111 and removed or recovered as streams 124E, 119E and 118E respectively.

Table I list typical process condition for the process of this invention carried out in accord with the embodiment of FIG. 1. The values were obtained from a computer simulation of the process of this invention and the stream numbers in Table I correspond to those of FIG. 1. The designation $C_2+$ denotes natural gas liquids. The computer simulation included a single column nitrogen rejection unit driven by a heat pump employing a mixture of nitrogen and methane as the heat pump fluid. The computer simulation data is offered for illustrative purposes and is not intended to be limiting.

TABLE I

| Stream No. | Flow (lb-moles/hr) | Pressure (psia) | Temp (°K.) | Composition (mole percent) $N_2$ | $CH^4$ | $C_2+$ |
|---|---|---|---|---|---|---|
| 10 | 1000 | 850 | 302.6 | 12.0 | 71.0 | 17.0 |
| 12 | 1000 | 830 | 225 | 12.0 | 71.0 | 17.0 |
| 14 | 808 | 830 | 225 | 14.2 | 76.6 | 9.2 |
| 15 | 192 | 830 | 225 | 3.0 | 47.4 | 49.6 |
| 17 | 808 | 505 | 204.2 | 14.2 | 76.6 | 9.2 |
| 19 | 755 | 505 | 204.2 | 15.0 | 78.8 | 6.2 |
| 20 | 53 | 505 | 204.2 | 2.1 | 45.5 | 52.4 |
| 22 | 192 | 505 | 214.0 | 3.0 | 47.4 | 49.4 |
| 24 | 43 | 505 | 214.0 | 9.8 | 82.5 | 7.7 |
| 25 | 148 | 505 | 214.0 | 1.1 | 37.1 | 61.8 |
| 33 | 148 | 250 | 278.9 | — | 0.5 | 99.5 |
| 36 | 799 | 503 | 183.7 | 14.7 | 79.0 | 6.3 |
| 38 | 619 | 502 | 183.7 | 17.6 | 80.1 | 2.3 |
| 39 | 180 | 503 | 183.7 | 4.8 | 74.9 | 20.3 |
| 43 | 180 | 403 | 181.7 | 4.8 | 74.9 | 20.3 |
| 45 | 46 | 402 | 181.7 | 11.8 | 85.8 | 2.4 |
| 46 | 134 | 402 | 181.7 | 2.4 | 71.1 | 26.5 |
| 53 | 44 | 200 | 202.7 | — | 22.2 | 77.8 |
| 55 | 90 | 390 | 166.4 | 99.9 | 0.1 | — |
| 55E | 90 | 380 | 283.8 | 99.9 | 0.1 | — |
| 56 | 575 | 250 | 159.1 | 4.2 | 93.1 | 2.7 |
| 56E | 672 | 240 | 283.8 | 4.0 | 92.8 | 3.2 |
| 57 | 90 | 200 | 165.7 | 3.5 | 95.0 | 1.5 |
| 57E | 90 | 195 | 283.8 | 3.5 | 95.0 | 2.5 |
| 58 | 97 | 250 | 193.7 | 2.8 | 90.8 | 6.4 |

The process of this invention allows one to effectively and efficiently separate natural gas liquids from natural gas which contains nitrogen regardless of the nitrogen concentration. The process of this invention is particularly advantageous when the nitrogen concentration of the natural gas is subject to change.

The process of this invention has been described in detail with respect to certain specific embodiments. Those skilled in the art will recognize that there are a number of other embodiments within the scope and spirit of the claims.

We claim:

1. A process for the separation of natural gas liquids from methane and nitrogen comprising:

(1) partially condensing a feed stream having a pressure in the range of from 300 to 1500 psia and containing natural gas liquids, methane and nitrogen to produce a vapor stream A and a liquid stream B;

(2) partially condensing stream A to produce a vapor stream C and a liquid stream D;

(3) partially vaporizing stream B to produce a vapor stream E and a liquid stream F;

(4) introducing streams D and F into a first demethanizer for separation into a methane-rich fraction and a bottom liquid containing natural gas liquids;

(5) partially vaporizing said bottom liquid from the first demethanizer to produce a vapor stream G and a liquid stream H;

(6) partially condensing streams C and E to produce a vapor stream I and a liquid stream J;
(7) partially vaporizing stream J to produce a vapor stream K and a liquid stream L;
(8) introducing stream L into a second demethanizer for separation into a methane-enriched fraction and a bottom liquid containing natural gas liquids;
(9) partially vaporizing said bottom liquid from the second demethanizer to produce a vapor stream M and a liquid stream N;
(10) introducing stream M into the second demethanizer;
(11) introducing streams G and N into the first demethanizer; and
(12) recovering stream H as product natural gas liquids whereby the presence of nitrogen and any changes which may occur in the concentration of nitrogen in the feed stream are prevented from having a significant impact in the hydrocarbon separation.

2. The process of claim 1 wherein the feed stream additionally contains helium.

3. The process of claim 1 wherein the partial condensation of step (2) is carried out by turboexpansion of stream A.

4. The process of claim 1 wherein the partial vaporization of step (3) is carried out by valve expansion of stream B.

5. The process of claim 4 wherein partially vaporized stream B is heated after the valve expansion.

6. The process of claim 1 wherein said first demethanizer is operating at a pressure in the range of from 100 to 600 psia.

7. The process of claim 1 wherein the feed stream additionally contains hydrogen and/or unsaturated hydrocarbons.

8. The process of claim 1 wherein at least a portion of the methane-rich fraction from the first demethanizer is partially condensed and the liquid portion returned to said first demethanizer.

9. The process of claim 1 wherein the concentration of nitrogen in the feed stream is at least 10 percent.

10. The process of claim 1 wherein streams I and K are introduced into a nitrogen rejection unit for separation into nitrogen-rich and methane-rich streams.

11. The process of claim 10 wherein said nitrogen rejection unit is a double column.

12. The process of claim 10 Wherein said nitrogen rejection unit is a single column.

13. The process of claim 12 wherein said single column is driven by a heat pump employing a mixture of methane and nitrogen as the heat pump fluid.

14. The process of claim 1 wherein at least some of at least one of the methane-rich fraction from the first demethanizer and the methane-enriched fraction from the second demethanizer is recovered as product methane.

15. The process of claim 10 wherein at least some of the methane-rich stream from the nitrogen rejection unit is recovered as product methane.

16. The process of claim 1 wherein streams C and E are combined prior to the partial condensation of step (6).

17. A process for the separation of natural gas liquids from a feed stream having a pressure in the range of from 300 to 1500 psia and containing natural gas liquids, methane and not more than about 20 percent nitrogen comprising:
(1) partially condensing said feed stream to produce a first vapor stream and a first liquid stream:
(2) expanding to partially vaporize said first liquid stream;
(3) heating said partially vaporized stream;
(4) separating said partially vaporized stream into a second vapor stream and a second liquid stream;
(5) partially condensing said first vapor stream to produce a third vapor stream and a third liquid stream;
(6) introducing said second and third liquid streams into a demethanizer wherein they are separated into a methane-rich fraction and a bottom liquid containing natural gas liquids;
(7) partially vaporizing said bottom liquid to provide vapor, for upflow through the demethanizer, and remaining liquid; and
(8) recovering said remaining liquid as product natural gas liquids.

18. The process of claim 17 wherein the partial condensation of step (5) is carried out by turboexpansion of the first vapor stream.

19. The process of claim 17 wherein the demethanizer is operating at a pressure in the range of from 100 to 600 psia.

20. The process of claim 17 wherein at least some of at least one of the second vapor stream, the third vapor stream and the methane-rich fraction is recovered as product methane.

21. The process of claim 17 wherein at least some of at least one of the second vapor stream, the third vapor stream and the methane-rich fraction is further separated into methane-richer and nitrogen richer fractions.

22. The process of claim 17 wherein the heating of step (3) is carried out by passing the partially vaporized stream against the feed stream.

* * * * *